US005873375A

United States Patent [19]

Johnson et al.

[11] Patent Number: 5,873,375

[45] Date of Patent: Feb. 23, 1999

[54] FINGERNAIL STENCIL SYSTEM USING PRECUT DESIGN MASKS

[76] Inventors: James Johnson; Dianne Dagnolo, both of 25291 Parthenon, Mission Viejo, Calif. 92691

[21] Appl. No.: 30,798

[22] Filed: Feb. 26, 1998

[51] Int. Cl.[6] ..... A45D 29/00

[52] U.S. Cl. ..... 132/200; 132/285

[58] Field of Search ..... 132/200, 73, 73.5, 132/285; 424/61; 428/343; 33/563; 101/127; 433/136

[56] References Cited

U.S. PATENT DOCUMENTS

| | | | |
|---|---|---|---|
| 2,323,145 | 6/1943 | Marby | 132/285 |
| 2,816,555 | 12/1957 | Klump | 132/73 |
| 2,864,384 | 12/1958 | Walter | 132/73 |
| 3,736,946 | 6/1973 | Yando et al. | 132/73 |
| 4,824,702 | 4/1989 | Straub | 132/73 |
| 4,960,587 | 10/1990 | Rucker | 132/73 |
| 5,427,121 | 6/1995 | Polito | 132/200 |
| 5,525,389 | 6/1996 | Hoffmann et al. | 132/73 |
| 5,724,999 | 3/1998 | Kim | 132/200 |

*Primary Examiner*—Gene Mancene
*Assistant Examiner*—Pedro Philogene
*Attorney, Agent, or Firm*—Frank D. Gilliam

[57] ABSTRACT

A method of applying multi-colored designs to substrates such as fingernails or toenails. A mask/stencil is prepared by cutting a design in a thin flexible plastic sheet held on a backing sheet by a low tack adhesive. Preferably, the mask/stencil is cut in a computer driven plotter using a sharp blade in place of the usual pen. The mask/stencil is removed from the backing sheet and placed on the substrate with openings corresponding to the design. A colorant is applied over the mask/stencil and areas of the substrate exposed through the openings. The mask/stencil is then removed, leaving colored areas corresponding to mask/stencil openings. Additional mask/stencils with different openings corresponding to other portions of the final multi-color design are then applied, coated and removed.

12 Claims, 1 Drawing Sheet

FINGERNAIL STENCIL SYSTEM USING PRECUT DESIGN MASKS

FIELD OF THE INVENTION

This invention relates to of forming a mask/stencil and using the masks to form widely varied multi-colored decorative patterns on substrates such as natural or synthetic fingernails and toenails.

BACKGROUND OF THE INVENTION

A wide variety of substrates are coated with single color or multicolor patterns for personal adornment and the like. Nail polish is often applied to fingernails and/or toenails, both natural nails and artificial nails, generally formed from acrylics and adhesively bonded over natural nails. Generally, a single color is applied to the entire nail, with perhaps a base coat under the polish and a clear or other coat over the polish for varied optical effects. Sometimes, a pattern of different colored polish is applied or sequins, glitter, etc. are added to the still wet polish.

Forming small, sharply patterned areas on the nails is quite difficult. Free hand painting of designs requires considerable skill and is difficult on small areas such as fingernails. Masking tape and the like can be used to mask off part of the nail, although only straight edged, large, patterns can be accomplished.

Attempts have been made to silk screen patterns onto fingernails, as is described by Jenkins in U.S. Pat. No. 5,316,026. This method uses fairly expensive screens and generally has difficulty following the contour of a fingernail. This method appears to be only capable of printing a design on a central area of the fingernail using only one color per screen.

Stencils have been cut from relatively thick plastic in broad patterns, as described by O'Donnell in U.S. Pat. No. 2,031,225 and Rucker in U.S. Pat. No. 4,960,587. However, the stencils described in these patents are primarily intended for preventing polish from overlapping onto the moon of the nail or the finger adjacent skin, and are not described as suitable for the formation of areas having sharp, small patterns in plural colors.

Thus, there is a continuing need for improvements in methods of decorating substrates such as fingernail, toenails and the like, that will provide sharp edge, small patterns of different colors and that can be used to apply a number of patterns in different colors.

SUMMARY OF THE INVENTION

A thin plastic mask/stencil is manufactured in a unique manner and bonded to the fingernail or other substrate and the colorant, which may be conventional fingernail polish applied with a bristle brush, other coating materials applied with an airbrush, etc. Multiple mask/stencils may be used in seriatim to apply different coatings and colors to achieve highly decorative patterns.

A mask/stencil suitable for use in this decorating method is made from a thin, flexible plastic sheet, having a coating of low tack adhesive on one side. The plastic sheet is releasably mounted on a backing sheet forming a sandwich. A conventional computer plotter is set up with a sharp blade in place of the usual pen. The sandwich is positioned in the plotter with the backing sheet on the plotter table. The plotter is programmed in a conventional manner to move the blade across the sandwich, cutting through the plastic sheet and very slightly into the backing sheet. Any desired pattern can be produced, including very fine, exact and small patterns. Both a positive and a negative patterns are produced (i.e.,a pattern of small circles can be cut, the circles with the background removed being a positive pattern and the sheet with the circles removed being a negative pattern). The sandwich is removed from the plotter and is ready for use. For the purposes of this application "mask stencil" means any thin sheet having any selected pattern cut through the sheet in a manner allowing portions to be easily removed for use and negtive or positive stencils or masks.

When a desired pattern of shapes and colors is selected, the appropriate mask/stencils are gathered. Generally, a base or background color is applied. Then, the backing sheet and unneeded portions of the pattern are removed. The mask/stencil is lightly pressed against the fingernail or other substrate to be decorated. The mask/stencil adheres tightly to the surface, so that no coating material can seep under an edge. The first color is then applied, typically by brushing with a bristle brush, foam brush or air brushing. The first mask/stencil is removed, and a second mask/stencil bearing other components of the design is positioned on the fingernail. A second color is then applied and the mask/stencil is removed. As many additional mask/stencils as desired may be used to build up a complex, multi-colored pattern. Also, different colors could be applied using the same mask/stencil.

When the pattern is complete, preferably a protective clear overcoating is then applied. Since the preferred colorants are fast drying, several different application steps can be accomplished in a relatively short time. Very small features will be sharply and accurately detailed, with no overrun between areas.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
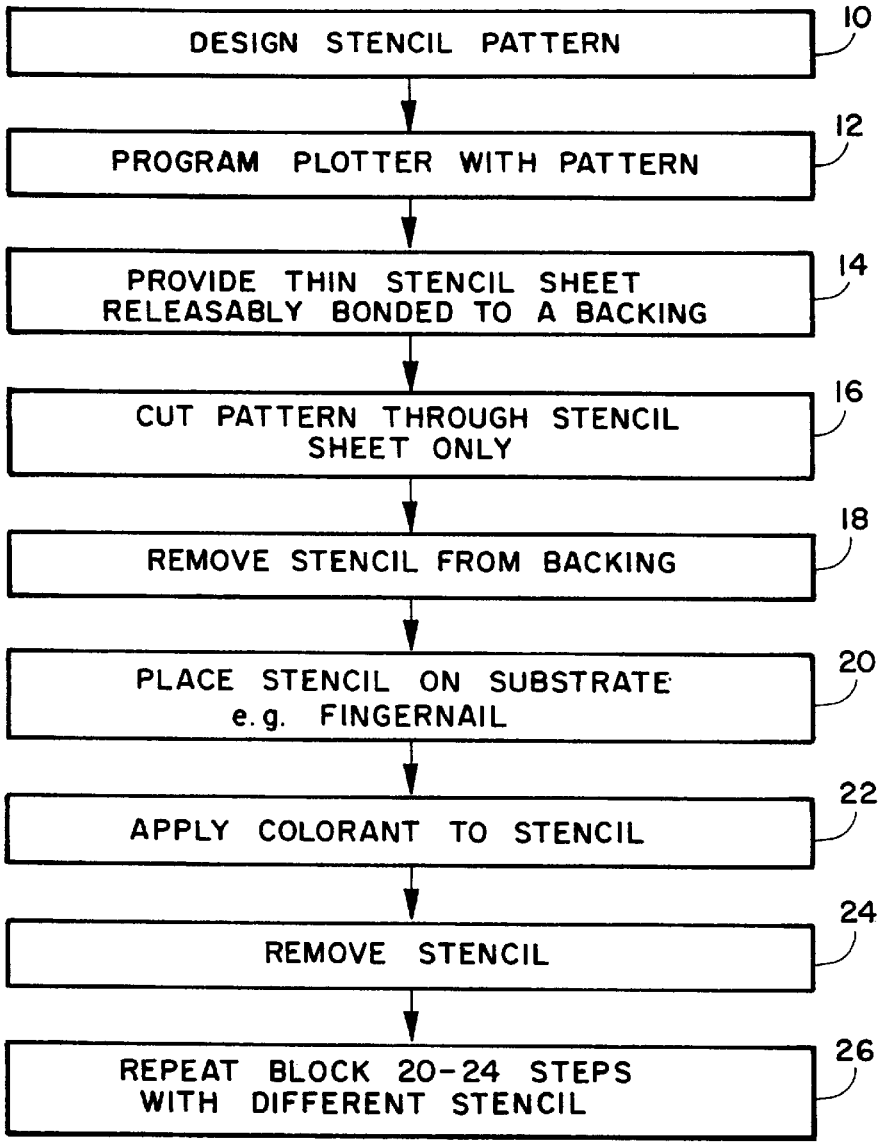
FIG. 1 is a flow diagram of the entire method of this invention.

Referring to FIG. 1 there is seen a flow diagram outlining the entire process of preparing mask/stencils and applying patterns to substrates such as fingernails, toenails, etc.

As indicated in Block 10, the pattern to be used must first be designed. An almost infinite variety of designs may be used. Each can use as many different colors and area shapes as desired. A design may include a single color component, or may use a number of components. For example, a design of eyes might use an outline, the eye background, pupils, eyebrows, etc. A design for Independence Day might use plural mask/stencils to provide a red, white and blue striped background, with an exploding firecracker superimposed thereover.

Typically, a substrate (hereinafter referred to as a fingernail for convenience in describing a preferred embodiment) is initially coated with a base coat to improve adhesion both to the fingernail and to subsequent color coats and to provide a depth effect where later coats are translucent. Typical base coats include Crystal white base coat and flat white base coats.

Next, a conventional computer driven plotter is programmed as indicated in Block 12 to trace each selected pattern component. While any suitable plotter may be used, a flat bed plotter of the sort sold by the Roland Digital Group under the PNC 1210 designation is preferred. In place of the conventional tracing pen, a thin, sharp, pointed blade is installed.

A mask/stencil assembly is provided as indicated in Block 14. A thin plastic sheet is bonded by a low tack adhesive to a backing sheet. Any suitable plastic sheet may be used. The sheet should be soft and flexible to bond to a curved substrate if such as a fingernail. A typical low tack adhesive is that used on the well known Post-it® notes. The backing sheet can be any material to which the plastic sheet will releasably adhere. Conventional coated paper is preferred.

The mask/stencil assembly is placed in the plotter and the plotter is activated as indicated in Block 16 to cut through the plastic sheet and, at most, very slightly into the backing sheet. The plotter is capable of producing a very exact, sharp-edged cut.

The desired portions of the mask/stencil are then removed from the backing sheet, as indicated in Block 18. Either a positive or negative reproduction of the mask/stencil design can be made, as desired. For example, if the design is a series of small star shapes across the backing, either the stars can be removed and pressed onto the fingernail or the mask/stencil background can be removed and placed on the fingernail, leaving the stars on the backing sheet.

Once the positive or negative mask/stencil is selected and placed on the fingernail, a selected colorant is applied thereover. Any suitable coloring agent, such as conventional fingernail polish, air brush colors or paint may be applied. The colorant may be applied in any suitable manner, such as with a conventional bristle or foam brush, by air brushing, etc. With the star mask/stencil mentioned above is used and the stars are removed from the mask/stencil assembly backing assembly and pressed onto a fingernail, when a colorant is applied over the fingernail and star mask/stencil a pattern of stars in the base coat color appears on a field of the added colorant. Conversely, the background mask/stencil may be removed from the mask/stencil assembly, leaving the stars themselves on the backing sheet with the background sheet applied to the fingernail. Upon coating the fingernail and mask/stencil and removing the mask/stencil, a pattern of stars in the added colorant appears against a base coat background. Thus, each mask/stencil can be used in either manner as desired.

Upon completion of the coating, the mask/stencil portion on the fingernail is removed as indicated in block 24. If desired, the fingernail decoration could be considered complete at this time. Preferably, the fingernail is coated with a clear top coat to protect the decorative layer(s). Any suitable top coat may be used. Typical top coats include conventional long last sealers, nail art sealers and nail polish topcoats. Any suitable material maybe included in a top coat or added to a wet top coat, such as glitter or foils.

For the maximum decorative effect, in which different parts of an image are to be in different colors or to provide a multicolored picture or the like as indicated in Block 26, the steps of Blocks 20–24 may be repeated as many times as desired.

Figure 2:
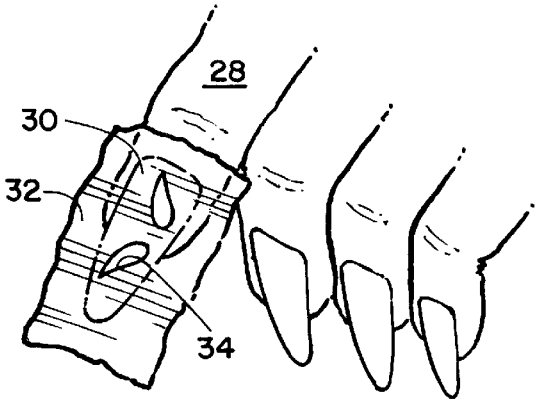
FIG. 2 is a plan view of a fingernail with a mask/stencil in place.

FIG. 2 illustrates the first color application step in a multi-component image. A finger 28 having a natural fingernail 30 is illustrated. Any other suitable substrate, such as a toenail, artificial fingernail, etc. could be used. Fingernail 30 has preferably been coated with a suitable base coat. With the "eyes" design illustrated, the backing could be a dark blue, gray, black, etc. A mask/stencil 32 having a pattern of two eyes 34 cut out is chosen. When mask/stencil 32 is removed from a backing sheet (not shown), the eye portions are left on the backing sheet. The mask/stencil and uncovered fingernail portions are coated with a suitable colorant, such as a conventional fingernail polish, typically in a white or light yellow color.

Figure 3:
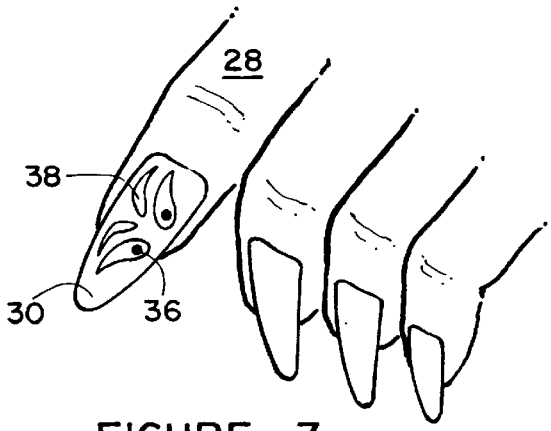
FIG. 3 is a plan view of a typical finished fingernail.

Additional mask/stencils 32 may then be used to add further features to the decorative design. FIG. 3 illustrates the fingernail 30 of FIG. 2 after additional mask/stencils have been used to apply pupils 36 and eyebrows 38 to the design. Once the design is complete and the final mask/stencil is removed, preferably a clear top coat is applied to protect the design.

While application to fingernials and the like is the primary intended use of this system, other suitable substrates may be used. Colorants may be applied using any suitable method, such as by using a paint brush, nail polish brush, foam brush, air brush, sponge, etc.

While certain specific relationships, materials and other parameters have been detailed in the above description of preferred embodiments, those can be varied, where suitable, with similar results. Other applications, variation and ramifications of the present invention will occur to those skilled in the art upon reading the present disclosure. Those are intended to be included within the scope of this invention as defined in the appended claims.

I claim:

1. A method of forming predetermined patterns on a substrate selected from the group consisting of fingernails and toenails, which comprises the steps of:

(a) providing a computer driven cutting plotter;

(b) providing a thin flexible plastic sheet having a low tack adhesive on one surface with a backing sheet bonded to said one surface;

(c) operating said computer driven cutting plotter to cut a predetermined pattern only through said plastic sheet to form a mask/stencil;

(d) removing said mask/stencil from said backing sheet with said mask/stencil having openings corresponding to said predetermined mask/stencil pattern;

(e) bonding said mask/stencil to said substrate;

(f) applying a coat of a colorant to said mask/stencil and said openings; and (g) removing said mask/stencil.

2. The method according to claim 1, further including repeating steps (e)–(g) with at least one additional mask/stencil, each additional mask/stencil having a different pattern.

3. The method according to claim 1, further including the steps of applying a uniform base coat to said substrate prior to initially bonding a mask/stencil thereto.

4. The method according to claim 1, further including the step of coating said substrate with a clear top coat after removal of said mask/stencil.

5. The method according to claim 1, wherein at least some colorants and coatings are applied by brushing with a bristle or foam brush.

6. The method according to claim 1, wherein at least some colorants and coatings are applied by air brushing.

7. The method according to claim 1, further including repeating steps (d)–(g) with at least one different mask/stencil formed in accordance with steps (a)–(c).

8. A method of applying multiple colored designs to substrates which comprises the steps of:

(a) preparing a first mask/stencil by operating a cutting plotter to cut a predetermined design in a thin flexible plastic sheet held on a backing sheet by a low tack adhesive, said cut extending through said thin flexible plastic sheet and not through said backing sheet;

(b) removing said mask/stencil from said backing sheet so that said mask/stencil has at least some open areas corresponding to said predetermined design;

(c) bonding said mask/stencil to a surface by said adhesive (d) applying a colorant to said first mask/stencil and said open areas;

(e) removing said mask/stencil leaving said predetermined design in said colorant;

(f) repeating steps (a)–(e) at least one additional time using a different predetermined design with each repeat of said steps.

9. The method according to claim 8, further including the steps of applying a uniform base coat to said substrate prior to initially bonding a mask/stencil thereto.

10. The method according to claim 8, further including the step of coating said substrate with a clear top coat after removal of said mask/stencil.

11. The method according to claim 8, wherein at least some colorants and coatings are applied by brushing with a bristle or foam brush.

12. The method according to claim 8, wherein at least some colorants and coatings are applied by air brushing.

* * * * *